US008575789B2

(12) United States Patent
Kubo

(10) Patent No.: US 8,575,789 B2
(45) Date of Patent: Nov. 5, 2013

(54) IMAGE FORMING APPARATUS

(75) Inventor: Isao Kubo, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 1267 days.

(21) Appl. No.: 12/406,326

(22) Filed: Mar. 18, 2009

(65) Prior Publication Data

US 2009/0238621 A1 Sep. 24, 2009

(30) Foreign Application Priority Data

Mar. 19, 2008 (JP) ..... 2008-071995

(51) Int. Cl.
*G03G 15/00* (2006.01)

(52) U.S. Cl.
USPC ..... 307/154; 361/154

(58) Field of Classification Search
USPC ..... 307/154; 361/154
See application file for complete search history.

(56) References Cited

U.S. PATENT DOCUMENTS

| | | | | |
|---|---|---|---|---|
| 5,268,726 A | * | 12/1993 | Oleksa et al. | 399/322 |
| 5,628,042 A | * | 5/1997 | Less | 399/78 |
| 5,931,379 A | | 8/1999 | Kim | |

FOREIGN PATENT DOCUMENTS

| | | | |
|---|---|---|---|
| JP | 56-161617 | A | 12/1981 |
| JP | 63-318720 | A | 12/1988 |
| JP | 64-41106 | U | 3/1989 |
| JP | 03-128697 | A | 5/1991 |
| JP | 05-212926 | | 8/1993 |
| JP | 09-52642 | A | 2/1997 |
| JP | 10-281477 | | 10/1998 |
| JP | 2001-74066 | A | 3/2001 |
| JP | 2001-113885 | | 4/2001 |
| JP | 2004-231068 | | 8/2004 |
| JP | 2007-178994 | | 7/2007 |

OTHER PUBLICATIONS

JP Office Action dtd Nov. 19, 2009, JP Appln. 2008-071995, English Translation.
JP Office Action dtd Mar. 23, 2010, JP Appln. 2008-071995, English translation.

* cited by examiner

*Primary Examiner* — Fritz M Fleming
(74) *Attorney, Agent, or Firm* — Banner & Witcoff, Ltd.

(57) ABSTRACT

An image forming apparatus includes: a carrier, a power unit, a switch, and a controller. The carrier is configured to carry a recording medium. The power unit is configured to provide drive power to the carrier. The switch is configured to switch an operation state of the carrier between an ON state and an OFF state of a transmission of the drive power from the power unit to the carrier. The controller is configured to provide a control power to control the switch such that the control power is reduced after switching from the OFF state to the ON state.

4 Claims, 8 Drawing Sheets

IMAGE FORMING APPARATUS

CROSS REFERENCE TO RELATED APPLICATION

This application claims priority from Japanese Patent Application No. 2008-071995 filed Mar. 19, 2008. The entire content of this priority application is incorporated herein by reference.

TECHNICAL FIELD

The present disclosure relates to an image forming apparatus, and more particularly, to the control of a solenoid switch employed therein.

BACKGROUND

A known art discloses an image forming apparatus comprising a solenoid switch for transmitting and cutting off a driving force sent from a driving source to a registration roller. In the art, a solenoid switch is turning on/off so that a paper sheet being delivered once stops at a registration roller and is held at its edge before being delivered to a transfer position at a prescribed timing.

However, the control of a solenoid switch in the art is performed merely by turning on/off the solenoid switch, and therefore, might generate mechanical noises when turning off or heat in the solenoid switch caused by larger electrical consumption used for keeping it turned on for a long time.

SUMMARY

In order to attain at least one of the above and other objectives, a technology is provided for implementing a more power-saving drive of a switch such as a solenoid switch.

This invention provides an image forming apparatus. The image forming apparatus includes: a carrier, a power unit, a switch, and a controller. The carrier is configured to carry a recording medium. The power unit is configured to provide a drive power to the carrier. The switch is configured to switch an operation state of the carrier by switching between an on state and an off state of a transmission of the drive power from the power unit to the carrier. The controller is configured to provide a control power to control the switch such that the control power is reduced after a switching from the off state to the on state.

In the image forming apparatus of the present invention, the controller is configured to provide a control power to control the switch such that the control power is reduced after a switching from the off state to the on state. This enables a power saving of the control power required for controlling the switch because the power for holding the status of the switch requires lower power than the power for switching the on-off status of the switch.

BRIEF DESCRIPTION OF THE DRAWINGS

Illustrative aspects in accordance with the invention will be described in detail with reference to the following figures wherein.

DETAILED DESCRIPTION

An image forming apparatus according to some aspects of the invention is explained hereafter via reference to FIGS. 1 to 8.

1. General Configuration of Printer

Figure 1:
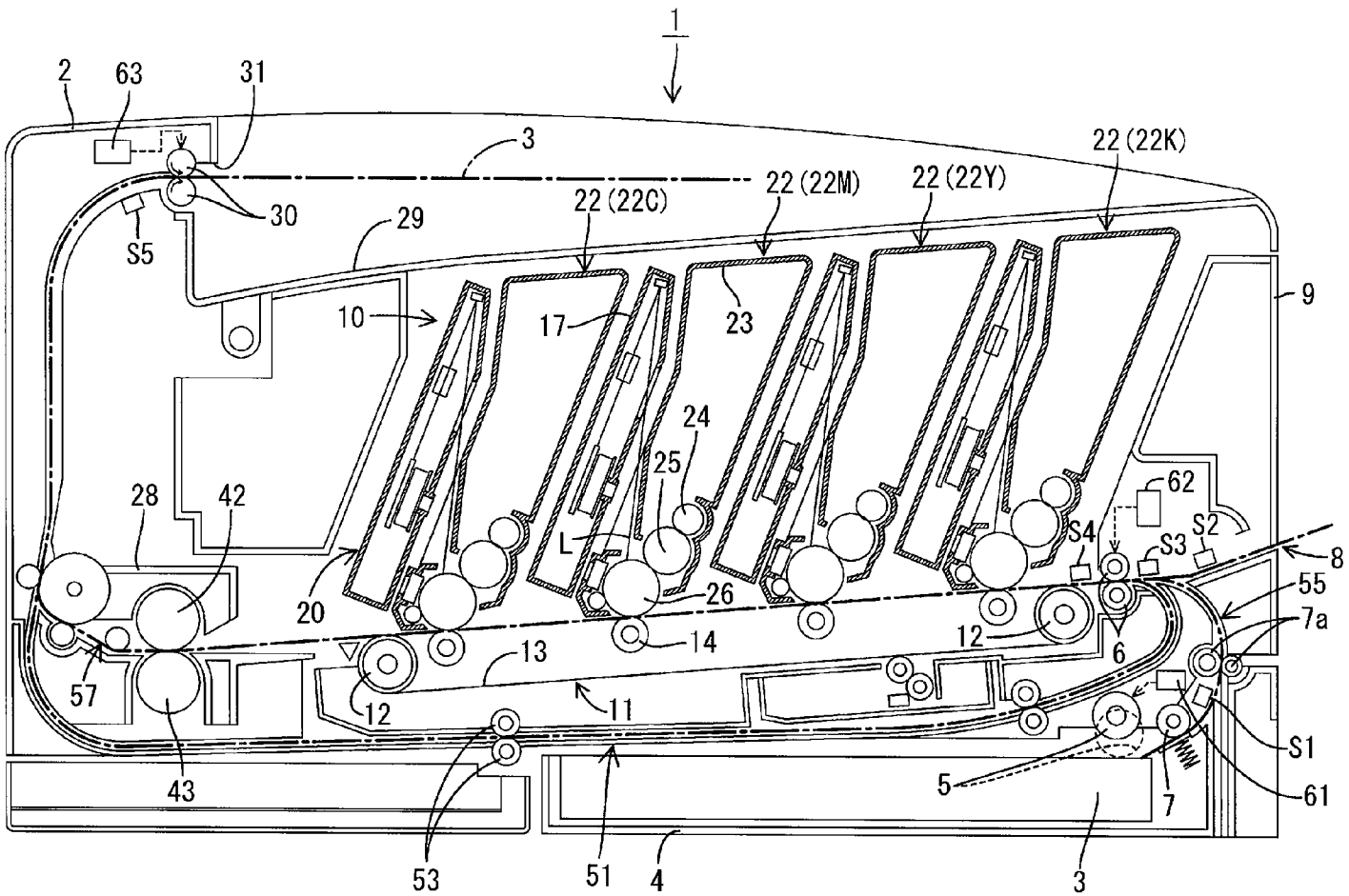
FIG. 1 is a sectional side view showing a general configuration of one aspect of an image forming apparatus of the present invention.
Figure 2:
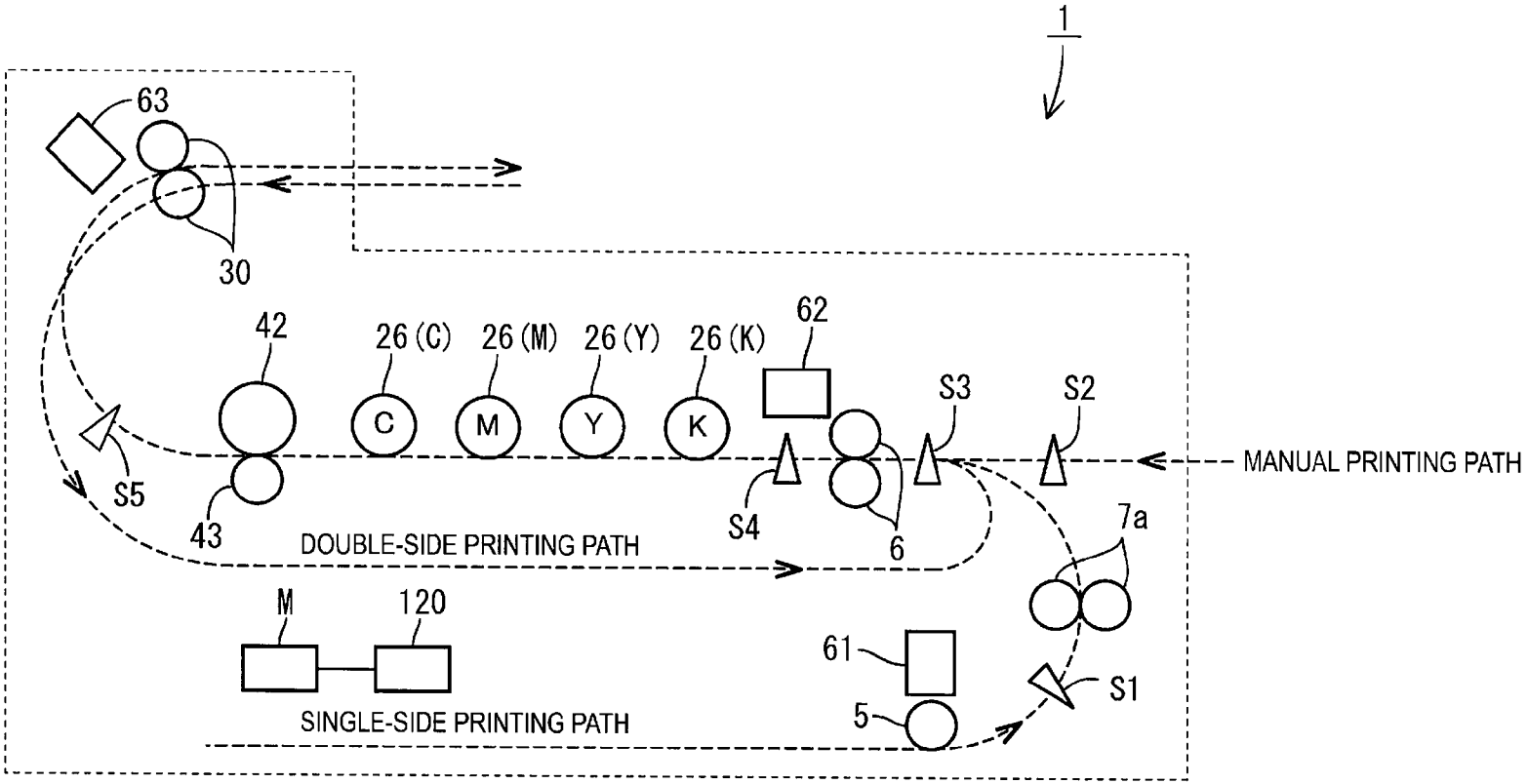
FIG. 2 is a configuration diagram schematically showing each moving path of a paper sheet at the time of various printings of an image forming apparatus in FIG. 1.
Figure 3:
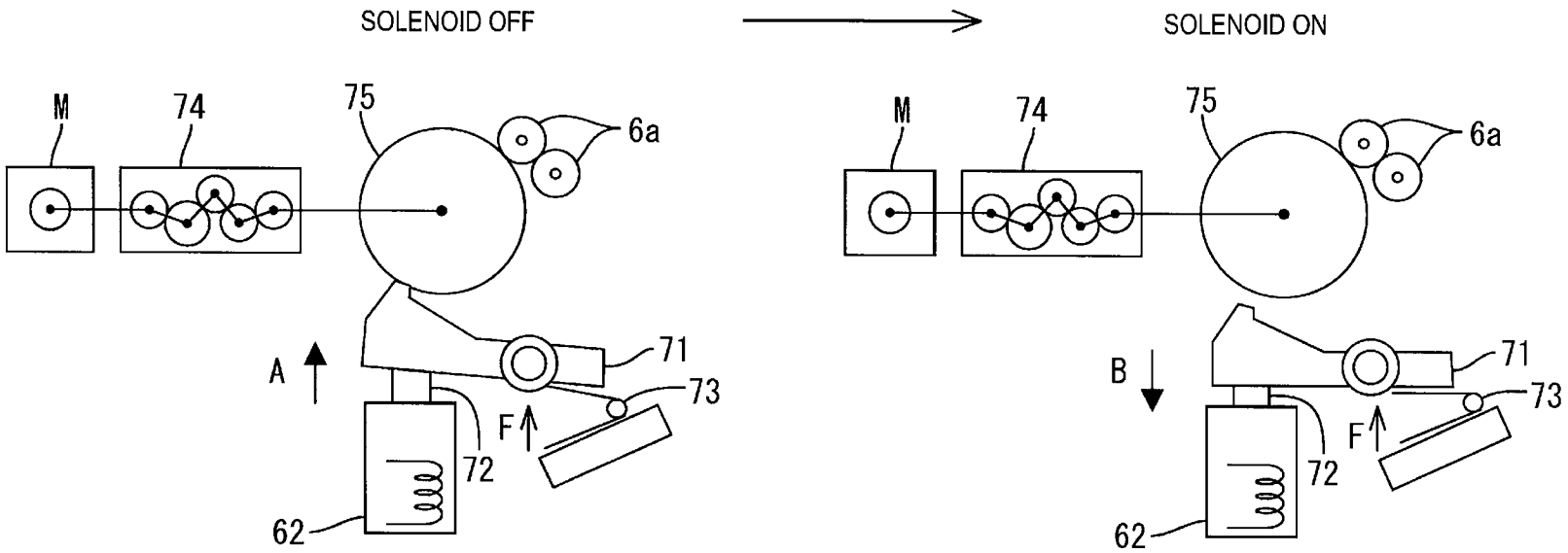
FIG. 3 is an explanation view schematically showing a motion of a registration solenoid at the time of ON/OFF.

Firstly, the general configuration of a printer is described in reference to FIGS. 1 to 3.

FIG. 1 is a sectional side view showing the general configuration of a color printer 1 as one example of an image forming apparatus of the present invention. FIG. 2 is a configuration diagram schematically showing the configuration according to each moving path of a paper sheet at single-side printing, double-side printing, and manual printing of the color printer 1. Additionally, in the following description, the right side in FIGS. 1 and 2 is the front of the color printer 1. In addition, an image forming apparatus is not limited to a color printer, and may be, for example, such as a black and white printer or a so-called MFP comprising such as a copying function.

The color printer 1 comprises a body casing 2, and provided in the bottom thereof is a paper tray 4 in which a paper sheet 3 (one example of a recording medium) is loaded. On the upper side of the front edge of the paper tray 4, a pick-up roller (one example of a carrier) 5, a paper feed roller 7, an auxiliary paper feed roller 7*a*, a paper end sensor S1, and a solenoid switch for the pick-up roller (one example of a switch) 61 are provided.

Along with the rotation of the pick-up roller 5, a paper sheet 3 loaded on the uppermost inside of the paper tray 4 is picked up, and then delivered to a registration roller 6 (one example of a carrier) by the paper feed roller 7 and the auxiliary paper feed roller 7*a*. The paper end sensor S1 detects the end of the paper sheet 3, that is to be delivered to the side of the registration roller 6. Also, the solenoid switch for pick-up roller (hereinafter referred to simply as "pick-up solenoid") 61 turns on/off such as the rotational power to be transmitted from a motor (one example of a power unit) M to the pick-up roller 5 via a power transmitting mechanism (not shown).

A paper feed opening (one example of an insertion opening) 8 for manually paper-feeding the paper sheet 3 is provided in the front surface of the body casing 2, and provided in the vicinity of the paper feed opening 8 is a manual insertion sensor (one example of a second detector) S2. The paper sheet 3 discharged from the paper feed opening 8 is detected by the manual insertion sensor S2, and then similarly carried to the registration roller 6.

In addition, a before-registration sensor (one example of a first detector) S3 is provided between the registration roller 6 and the manual insertion sensor S2, in short, in the front of the upstream side in the paper carrying direction of the registration roller 6, and detects the paper sheet 3 carried to the front of the registration roller 6. The registration roller 6 corrects the skew of the paper sheet 3, and then delivers the same onto a belt 13 at a prescribed timing. In addition, an after-registration sensor S4 is provided right behind the registration roller 6 in the downstream side, and detects the paper sheet 3 that has passed through the registration roller 6.

Moreover, a solenoid switch for registration roller (one example of a carrier) 62 for turning on/off the rotation of the registration roller 6 is provided in the vicinity of the registration roller 6. The solenoid switch for registration roller (hereinafter referred to simply as "registration solenoid") 62, as shown in FIG. 3, turns on/off the rotational power transmitted from a motor M to the registration roller 6 via a power transmitting mechanism 74, a planetary gear 75, and a registration roller gear 6*a*. Here, FIG. 3 is an explanation view schematically showing a motion of the registration solenoid 62 at the time of ON/OFF.

More particularly, in the OFF state of the registration solenoid 62, an iron core 72 in a clutch 71 is not sucked into the registration solenoid 62, and therefore the clutch 71 is pushed toward a direction A shown in FIG. 3 by a restoring force F of a spring 73 and then coupled with tooth of the planetary gear 75. In this time, a rotational power from the motor M is transmitted to the registration roller gear 6*a*, thereby rotating the registration roller 6. On the other hand, in the ON state of the registration solenoid 62, the iron core 72 in the clutch 71 is moved into a direction B shown in FIG. 3 against the restoring force F of the spring 73, and therefore, the clutch 71 is released from the joint with the tooth of the planetary gear 75, withdrawing from the planetary gear 75. In this time, a rotational power from the motor M is not transmitted to the registration roller gear 6*a*, and the registration roller 6 does not therefore rotate.

Next, returning now to FIG. 1, a printing unit 10 can include such as a belt unit 11, a processing unit 20, and a fixing device 28. The belt unit 11 has a structure including a belt 13 stretched between a pair of front and rear support rollers 12, and a drive of the belt 13 carries the paper sheet 3 placed on the belt 13 toward the rear side. In addition, inside of the belt 13, a transferring roller 14 is provided in each position opposed to each photoreceptor drum 26 in the processing unit 20, with the belt 13 positioned therebetween.

The processing unit 20 includes, for example, developing cartridges 22 (22Y, 22M, 22C, and 22K) corresponding to colors (yellow, magenta, cyan, and black). A scanning unit 17 is independently provided in each developing cartridge 22. The scanning unit 17 applies a laser light L emitted from a laser emitting unit (not shown) to the surface of each photoreceptor drum 26 corresponding to each color (respectively, 26Y, 26M, 26C, and 26K). This exposes the surface of the photoreceptor drum 26 based on printing data.

In each developing cartridge 22, such as a toner storing chamber 23 for storing each color toner as a developer, a feed roller 24, a developing roller 25, a photoreceptor drum 26, and a scorotron-type charger 27 are respectively provided.

The toner released from the toner-storing chamber 23 is fed to the developing roller 25 by the rotation of the feed roller 24, and here, thereby being positively and triboelectrically charged between the feed roller 24 and the developing roller 25. With the rotation, the surface of the photoreceptor drum 26 is, first of all, uniformly and positively charged by the charger 27, and then exposed by the laser light L emitted from the scanning unit 17, thereby forming an electrostatic latent image corresponding to an image ought to be formed on the paper sheet 3. Next, the rotation of the developing roller 25 supplies the toner on the developing roller 25 to the surface of the photoreceptor drum 26, thereby developing the electrostatic latent image as a visible image. After that, the toner image held on the surface of the photoreceptor drum 26 is then transferred onto the paper sheet 3 by a transferring bias voltage applied to the transferring roller 14 during the passage of the paper sheet 3 between the photoreceptor drum 26 and the transferring roller 14.

The paper sheet 3 after the transfer is then delivered to the fixing device 28 by the belt unit 11, and here, the transferred toner image is heat-fixed onto the paper sheet 3. In this way, the paper sheet 3 under goes a printing processing conducted by the printing unit 10 based on the printing data. The heat-fixed paper sheet 3 is then discharged onto a catch tray 29 provided in the upper surface of the body casing 2 by means of a paper-discharging roller 30 (one example of a carrier), that is rotationally driven by the motor M controlled by the later-described CPU 120 (one example of a controller) In this case, the paper sheet 3 is discharged on the catch tray 29 in a face down manner (in a state where the surface of the paper sheet 3 on which a toner image has been formed is on the lower side). In addition, a solenoid switch for paper-discharging roller (one example of a switch) 63 is provided in the vicinity of the paper-discharging roller 30, and to turn on/off the solenoid switch for paper-discharging roller (hereinafter referred to simply as "paper-discharging roller solenoid") 63 switches between positive rotation and inverse rotation of the paper-discharging roller 30.

Additionally, a re-carrying path 51 for double-side printing is provided in the lower part of the body casing 2 and positioned between the belt 13 and the paper tray 4. The re-carrying path 51 extends longitudinally in the body casing 2, and provided therein for carrying the paper sheet 3 to two positions on the path is a relay roller 53 rotationally driven by the motor M, that is controlled by the CPU 120. This re-carrying path 51 has a front end joining in the upstream side of the registration roller 6 with a carrying path 55 in a U shape extending from the above-mentioned paper feed roller 7, while having a rear end joining with a carrying path 57 extending from the belt 13 and the fixing device 28.

Moreover, a discharging sensor S5 is provided in the front of a discharging port 63 of the body casing 2. In double-side printing, the paper sheet 3 having a toner image heat-fixed thereonto is therefore carried to the paper feeding side through the re-carrying path 51 by the reverse rotation of the paper-discharging roller 30 right after passing through the discharging sensor S5. A toner image is then formed on the back surface of the paper sheet 3 by the printing unit 10, and the paper sheet 3 is discharged onto the catch tray 29, with the back surface side in a face down manner (meaning the front surface side in which a toner image has been firstly formed is in a face up manner). Accordingly, in the color printer 1, the above-mentioned configuration enables double-side printing for printing both surfaces of the paper sheet 3, as well as single-side printing for printing only one surface of the paper sheet 3 delivered from the paper tray 4.

2. Electrical Configuration

Figure 4:
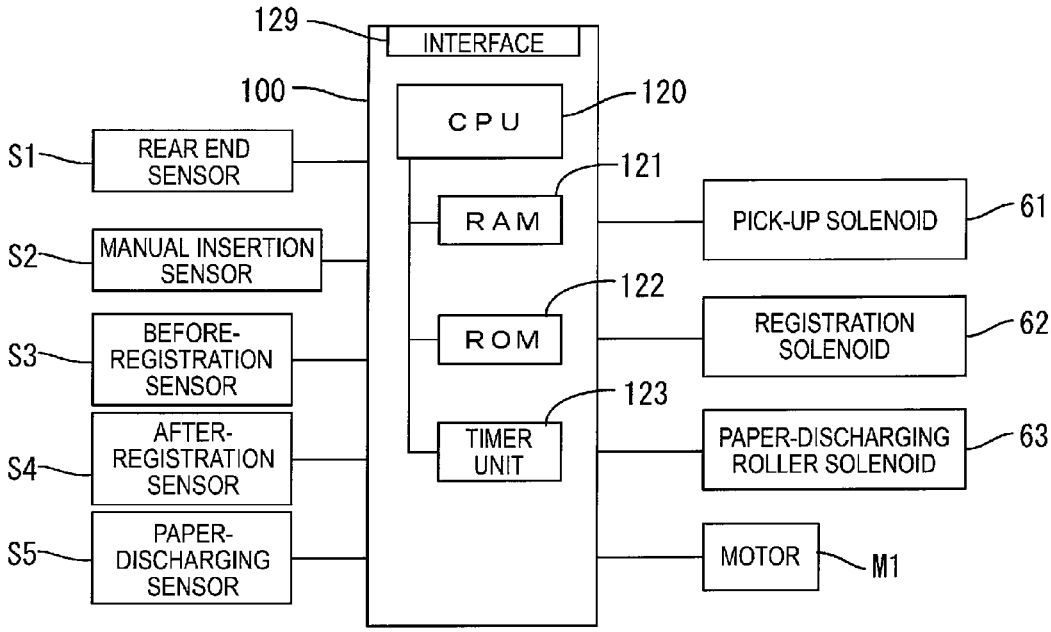
FIG. 4 is a circuit block diagram showing an electrical configuration according to the present invention of an image forming apparatus in FIG. 1.

Next, as referring to FIG. 4, the electrical configuration of a laser printer 1 according to the present invention is described.

As shown in FIG. 4, the laser printer 1 comprises a circuit substrate 100, which includes such as a CPU 120, RAM 121, ROM 122, and a timer 123. Such as a motor M, a rear end sensor S1, a manual insertion sensor S2, a before-registration sensor S3, an after-registration sensor S4, a paper-discharging sensor S5, a pick-up solenoid 61, a registration solenoid 62, and a paper-discharging roller solenoid 63 are connected with the circuit substrate 100. These are all connected to the CPU 120.

In addition, an interface 129 is provided in the circuit substrate 100 and enables communication with higher-level devices (for example, such as a personal computer not shown). On receiving printing data as well as printing instructions through the interface 120, the CPU controls the entire color printer 1 to form a desired image on the paper sheet 3.

The CPU 120 is, for example, composed of an ASIC (Application Specific Integrated Circuit) and controls such as the carrying timing of the paper sheet 3, in short, the starting timing of movements for operating each of the solenoid switches 61 to 63. In addition, such as a program storing area as well as a paper carrying data storing area are provided inside of the memory 122, while various controls of the CPU 120, for example, a processing program for conducting a processing according to the later-described Pulse Width Modulation (PWM) control of a solenoid switch are stored inside of the program storing area.

3. PWM Control of Solenoid Switch

Next, examples of the PWM control of the CPU 120 against solenoid switches are described in reference to FIGS. 5 to 8. The CPU 120 conducts the following PWM control of a solenoid switch in accordance with a prescribed processing program as mentioned above. And also, in the following description, the time with no particular explanation about when it is from a reference time is decided beforehand in such as experiments, and counted with, for example, a prescribed timer in the timer unit 123 from a prescribed reference time.

3-1. Control Example 1 of Registration Solenoid

Aspect 1

Figure 5:
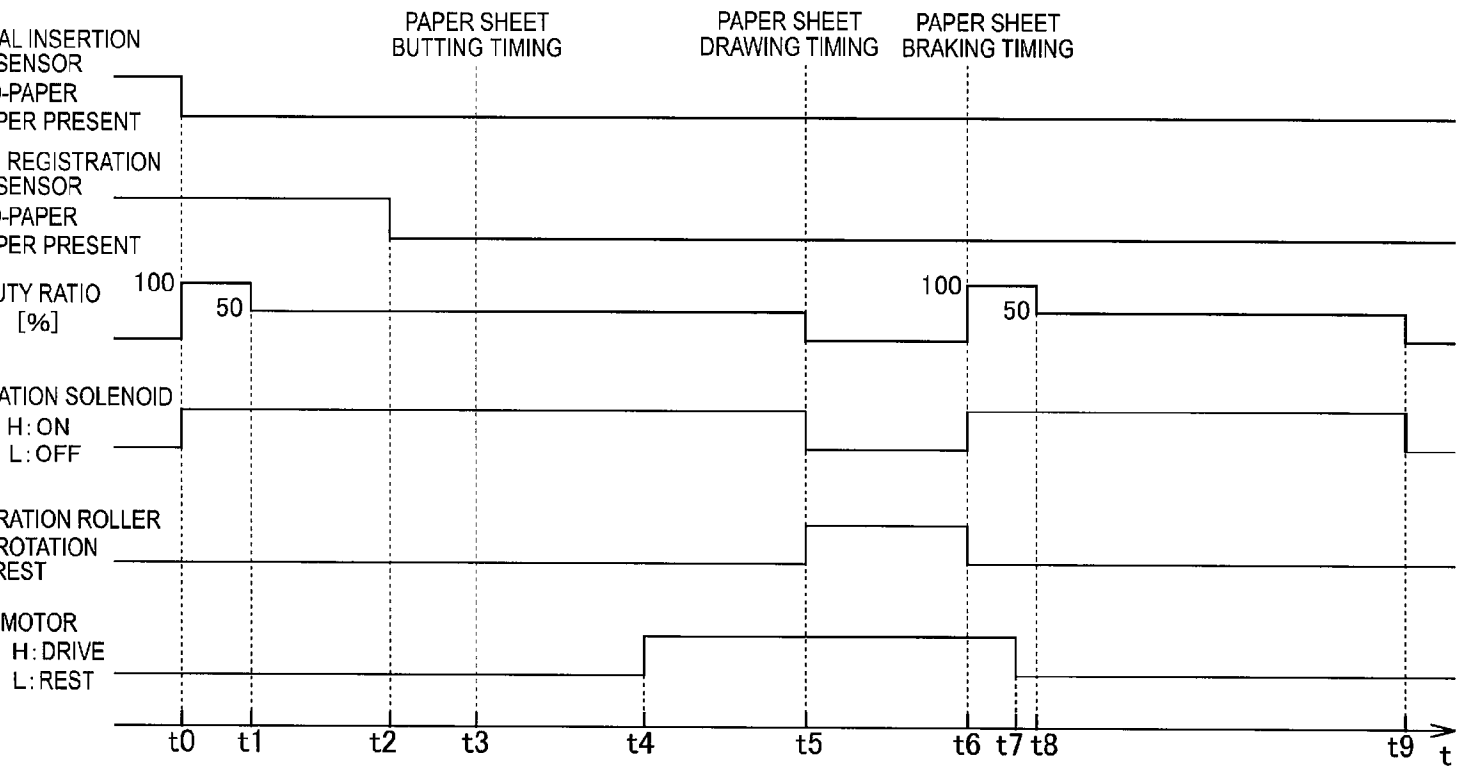
FIG. 5 is a time chart according to one example of a PWM control of a solenoid switch.

Firstly, in Aspect 1, one control example of the registration solenoid 62 is described as referring to FIG. 5.

When a user inserts the paper sheet 3 from the manual paper feed opening 8 in the color printer 1, and when the paper sheet 3 is detected by the manual insertion sensor S2 at a time t0 in FIG. 5, the manual insertion sensor S2 provides a detection signal on a low logical level to the CPU 120. According to the detection signal, the CPU 120 then provides a PWM signal of 100% duty ratio to the registration solenoid 62, thereby turning on (ON) the registration solenoid 62. Then, as shown in FIG. 3, the iron core 72 of the clutch 71 is moved into the registration solenoid 62 such that the clutch is withdrawn from the planetary gear 75.

Additionally, the duty ratio for turning on the registration solenoid 62 is not limited to 100%, and may be, for example, 90% or 95%. In short, any duty ratio of the PWM signal which can withdraw the clutch 71 from the planetary gear 75 by turning on the registration solenoid 62 may be possible.

Next, at a time t1 when a predetermined period of time has passed from the time t0, the CPU 120 reduces the duty ratio of the PWM signal from 100% to 50%. Here, the reason for reducing the duty ratio of the PWM signal after the start of the registration solenoid 62 is as follows.

In short, at the time of start of the registration solenoid 62, energy larger than that at the start is required for withdrawing the clutch 71 from coupling with the planetary gear 75. This is the reason why energy for holding the clutch 71 in a withdrawn state after the withdrawal from the planetary gear 75 can be smaller than that for withdrawing the clutch 71.

Therefore, in a case where the duty ratio of the PWM signal (after the start of the registration solenoid 62) is reduced, the driving energy can be saved, compared with the case where the duty ratio of the PWM signal is set constantly at 100% even after the start of the registration solenoid 62.

In addition, the reduced duty ratio may be at least a value that can hold the clutch 71 in a state withdrawn from the planetary gear 75, and not limited to 50%. For example, the reduced duty ratio may be 40% or 65%, and may only have to be set in accordance with the energy required for holding. In either case, compared with a case for holding at 100% duty ratio, the driving energy can be saved.

Next, when the before-registration sensor S3 detects the paper sheet 3 at a time t2, a detection signal on a low logical level is provided to the CPU 120. When the paper sheet 3 moves further, the paper sheet 3 abuts on the registration roller 6 around a time t3. Next, at a time t4 when a predetermined period of time has passed from the time t3, the CPU 120 starts driving the motor M. And then, at a time t5 as a paper sheet drawing timing when a predetermined period of time has passed from the time t4, the CPU 120 reduces the duty ratio of the PWM signal from 50% to 0%, thereby turning off (OFF) the registration solenoid 62. Then, as shown in FIG. 3, the iron core 72 of the clutch 71 is moved from the registration solenoid 62 by means of a restoring force F of the spring 73, so that the clutch 71 couples with the planetary gear 75. Here, the rotational power of the motor M is transmitted to the registration roller 6 through the power transmitting mechanism 74, the planetary gear 75, and the registration roller gear 6 to rotate the registration roller 6, thereby moving the paper sheet 3 down into the registration roller 6.

And then, at a time t6 for stopping drawing the paper sheet 3, the CPU 120 provides the PWM signal having a 100% duty ratio to the registration solenoid 62, thereby turning on the registration solenoid 62. Then, the iron core 72 of the clutch 71 is sucked into the registration solenoid 62 such that the clutch is again withdrawn from the planetary gear 75. The transmission of the rotational power of the motor M to the registration roller 6 is then cut off to stop the rotation of the registration roller 6, so that the drawing of the paper sheet 3 by the registration roller 6 is stopped, and an edge of the paper sheet 3 is held between the rollers.

Next, at a time t7 when a predetermined period of time has passed from the time t6, the CPU 120 stops driving the motor M. And then, the CPU 120, similar to the time t1, reduces the duty ratio of the PWM signal from 100% to, for example, 50% at a time 8 when a predetermined period of time has passed from the time t7 for stopping the motor, and therefore, the registration solenoid 62 holds the clutch 1 in a state withdrawn from the planetary gear 75.

Then, at a time t9 when a predetermined period of time has passed from the time t8, the CPU 120, as same as the time 5, reduces the duty ratio of the PWM signal from 50% to 0%, thereby turning off (OFF) the registration solenoid 62. Here, the iron core 72 of the clutch 71 is moved from the registration solenoid 62 by means of a restoring force F of the spring 73, so that the clutch 71 couples with the planetary gear 75. However, the registration roller 6 does not rotate since the motor M at this moment is stopped. In the above manner, a printing preparation is completed.

In Aspect 1, as mentioned above, the CPU 120, after turning the registration solenoid 62 from OFF state to ON state, controls the duty ratio of the PWM signal (for example, 50%) as a driving signal of the registration solenoid 62 so as to be less than the value at starting (for example, 100%). This is why the driving energy for the registration solenoid 62 is saved, while at the same time, the heat generated from the registration solenoid is controlled.

In addition, the registration solenoid 62 is employed in Aspect 1 as an example of a solenoid switch, but not limited to this. The control shown in Aspect 1 for reducing the duty ratio of the PWM signal after starting a solenoid may be applied also to the pick-up solenoid 61 and the paper-discharging roller solenoid 63, both as a solenoid switch.

3-2. Control Example 2 of Registration Solenoid

Aspect 2

Figure 6:
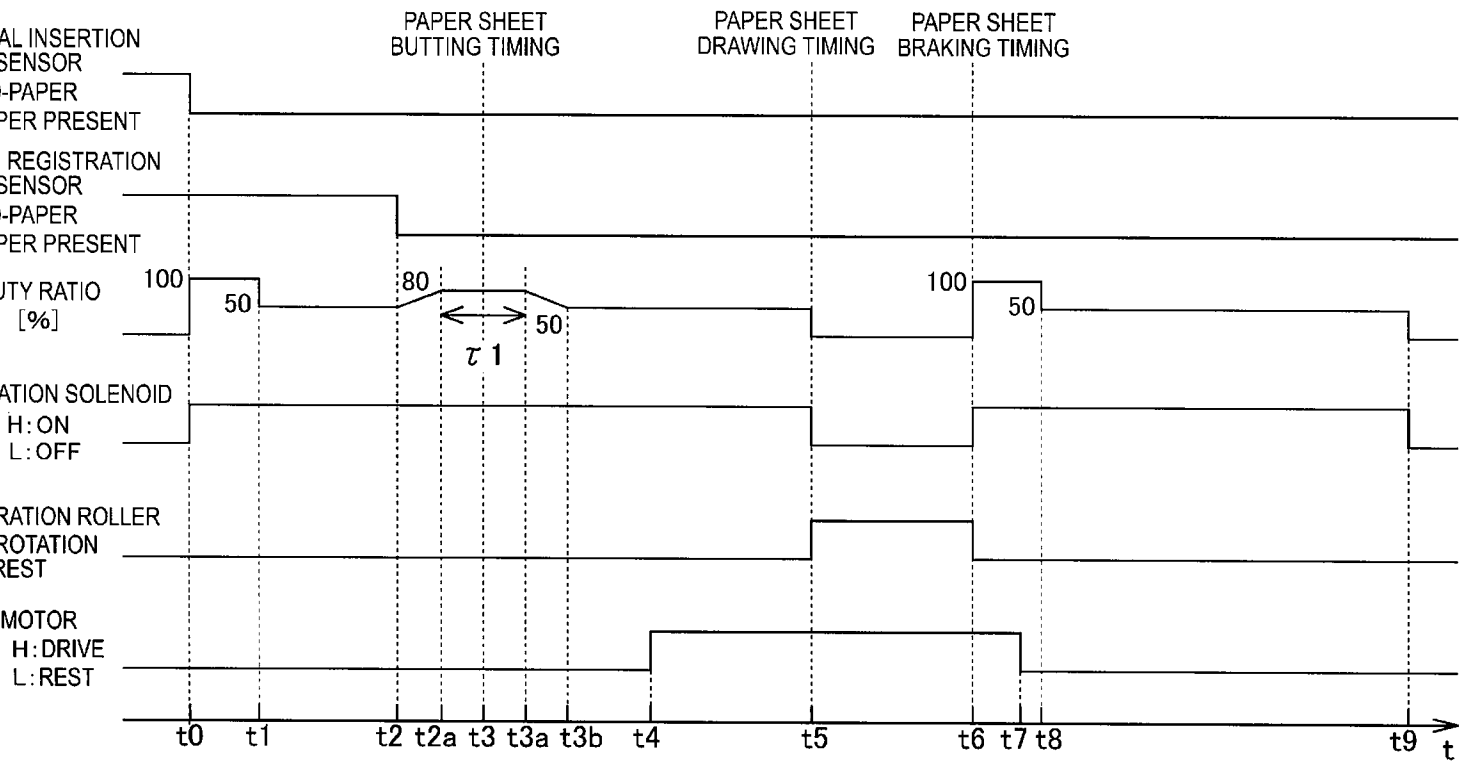
FIG. 6 is a time chart according to another example of a PWM control of a solenoid switch.

Next, in Aspect 2, another control example of the registration solenoid 62 is described as referring now to FIG. 6. Additionally, the times t0 to t9 in FIG. 6 indicate the same times as those in Aspect 1. Therefore, a description repeating that in Aspect 1 is omitted, thereby describing only the elements different from those in Aspect 1.

In Aspect 2, as shown in FIG. 6, the duty ratio of the PWM signal for holding the clutch 71 (for example, 50%) after turning the registration solenoid 62 from OFF state to ON state is not set as a constant value, but changed according to conditions such as a disturbance. In short, in Aspect 2, the CPU 120 increases the duty ratio of the PWM signal at least after the before-registration sensor S3 detected the paper sheet 3.

In particular, when the before-registration sensor S3 detects the paper sheet 3 at the time t2, the CPU 120 gradually increases the duty ratio of the PWM signal from 50%, in order to increase, for example, up to 80% in a period between the time t2 and a time t2*a*. Preferably, the duty ratio is increased at every predetermined period of time by a prescribed value.

Then, in a period of time τ1 from the time t2*a* to a time t3*a*, the CPU 120 sets the duty ratio of the PWM signal constantly at 80%. In addition, this period of time τ1 includes at least the time t3 when the paper sheet 3 abuts on the registration roller 6. The reason is as below.

In short, when the paper sheet 3 abuts on the registration roller 6, the vibration thereof is transmitted to the registration solenoid 62 since being positioned in the vicinity of the registration roller 6, and the registration solenoid 62 might release its hold of the clutch 71. When the hold of the clutch 71 is released, the clutch 71 is pushed out from the registration solenoid 62 by the restoring force F of the spring 73, thereby coupling with the planetary gear 75. When the motor M is driven at the time t4 with the clutch 71 coupled with the planetary gear 75, the registration roller 6 starts rotating and draws down the paper sheet 3, with the result of drawing more of the paper sheets 3 than a prescribed amount. This causes a trouble in the later described printing processing. In Aspect 2, during the period of time τ1 including at least the time t3 when the paper sheet 3 abuts on the registration roller 6, the duty ratio of the PWM signal is therefore increased from 50% to 80%, so that the clutch 71 is surely held even with vibration caused by the impact on the paper sheet 3 at the time of abutting on the registration roller 6. Additionally, the increased duty ratio of the PWM signal is not limited to 80%, and may be at least the value that can surely hold the clutch 71, possibly, for example, 75% or 85%. The period of time τ1 is counted with, for example, a prescribed timer in the timer unit 123.

Next, in a period between the time t3*a* and a time t3*b*, the duty ratio of the PWM signal is reduced preferably at every predetermined period of time by a prescribed value, in order to be reduced to, for example, 50%. Then, from the time t4 that is subsequent to the time t3*b*, the same processing as in Aspect 1 is conducted.

As mentioned above, in Aspect 2, the CPU 120 increases the duty ratio of the PWM signal after the before-registration sensor S3 detected the paper sheet 3. The registration solenoid 62 can therefore preferably maintain the hold of the clutch 71 in a state withdrawn from the planetary gear 75, even with a disturbance such as vibration caused by the impact on the paper sheet 3 at the time of abutting on the registration roller 6.

3-3. Control Example 3 of Registration Solenoid

Aspect 3

Figure 7:
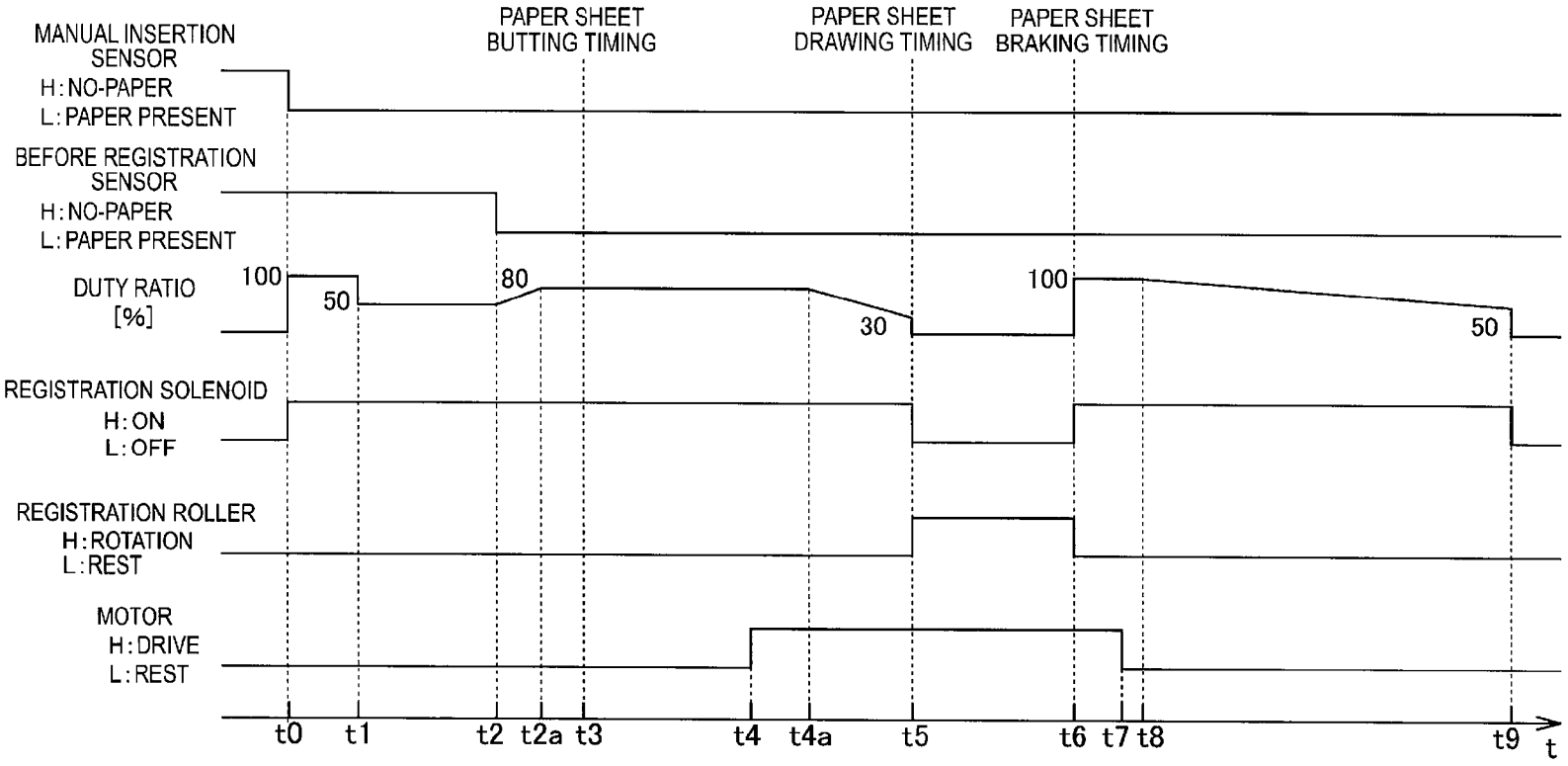
FIG. 7 is a time chart according to another example of a PWM control of a solenoid switch.

Next, in Aspect 3, another control example of the registration solenoid 62 is described as referring now to FIG. 7. Additionally, the times t0 to t9 in FIG. 7 indicate the same times as those in Aspect 1. Therefore, a description repeating that in Aspect 1 is omitted, thereby describing only the elements different from those in Aspect 1.

In Aspect 3, as shown in FIG. 7, the duty ratio (for example, 50%) of the PWM signal (for holding the clutch 71 after the registration solenoid 62 is turned from OFF state to ON state) is not set as a constant value but changed according to conditions such as a disturbance. On the other hand, the duty ratio is gradually reduced when the registration solenoid 62 is turned from ON state to OFF state. Preferably, the duty ratio is reduced at every predetermined period of time by a prescribed value. And also, the CPU 120 gradually reduces the value of the duty ratio when the paper sheet 3 is held between the registration rollers 6, at the time of warming-up. At that time, the duty ratio is preferably reduced at every predetermined period of time by a prescribed value.

In particular, when the before-registration sensor S3 detects the paper sheet 3 at the time t2, the CPU 120 gradually increases the duty ratio of the PWM signal from 50% up to, for example, 80% in a period between the time t2 and the time t2*a*. Preferably, the duty ratio is increased at every predetermined period of time by a prescribed value.

Then, unlike Aspect 2, during a period between the time t2*a* to a time t4*a*, which is subsequent to the time t4 for starting the motor M, the CPU 120 maintains the duty ratio of the PWM signal constantly at 80%. Here, in a period until the time t4*a*, the CPU 120 sets the duty ratio of the PWM signal constantly at 80%, for the purpose of restraining the hold of clutch 71 to be released by the registration solenoid 62 due to, for example, the vibration caused by the start of the motor M at the time t4. In other words, though increasing the power consumption, by extending the period for setting the duty ratio of the PWM signal constantly at 80% (compared with Aspect 1), thus allows the influence caused by disturbances to be further restrained.

Next, in a period between a time t5 and the time t4*a* for turning the registration solenoid 62 from ON state to OFF state, the duty ratio is gradually reduced from 80% to, for example, 30%. The clutch 71 can therefore be released from the registration solenoid 62, with the restoring force of the spring 3 reduced. Consequently, mechanical noises generated when the clutch 71 is coupled with the planetary gear 75 can be reduced.

Also, in a period between the time t8 and the time t9, the CPU 120 reduces the duty ratio of a state where the paper sheet 3 is held between the registration roller 6 gradually from, for example, 100% to 50%. At that time, the duty ratio is preferably reduced at every predetermined period of time by a prescribed value. In general, at the time of warming-up of the color printer 1, the registration solenoid 62 has to be generally turned ON until the end of warming-up so that the paper sheet 3 may not be carried to the section subject to the warming-up in the downstream than the registration roller 6 in the carrying direction, however, the control as mentioned above allows the power consumption to be largely saved. When turning OFF the registration solenoid 62 at the time t9, the mechanical noises generated when the clutch 71 couples with the planetary gear 75 can also be reduced.

As mentioned above, in Aspect 3, the CPU 120 increases the duty ratio of the PWM signal at least after the before-registration sensor S3 detected the paper sheet 3. Therefore, the registration solenoid 62 can preferably maintain the hold of the clutch 71 in a state withdrawn from the planetary gear 75, even with a disturbance such as vibrations caused by the impact on the paper sheet 3 at the time of abutting on the registration roller 6 or by the start of the motor M. Moreover, the mechanical noises generated when the registration solenoid 62 is turned OFF can be reduced, and at the same time, the power consumption of the registration solenoid can be saved.

3-4. Control Example 1 of Paper-Discharging Roller Solenoid

Aspect 4

Figure 8:
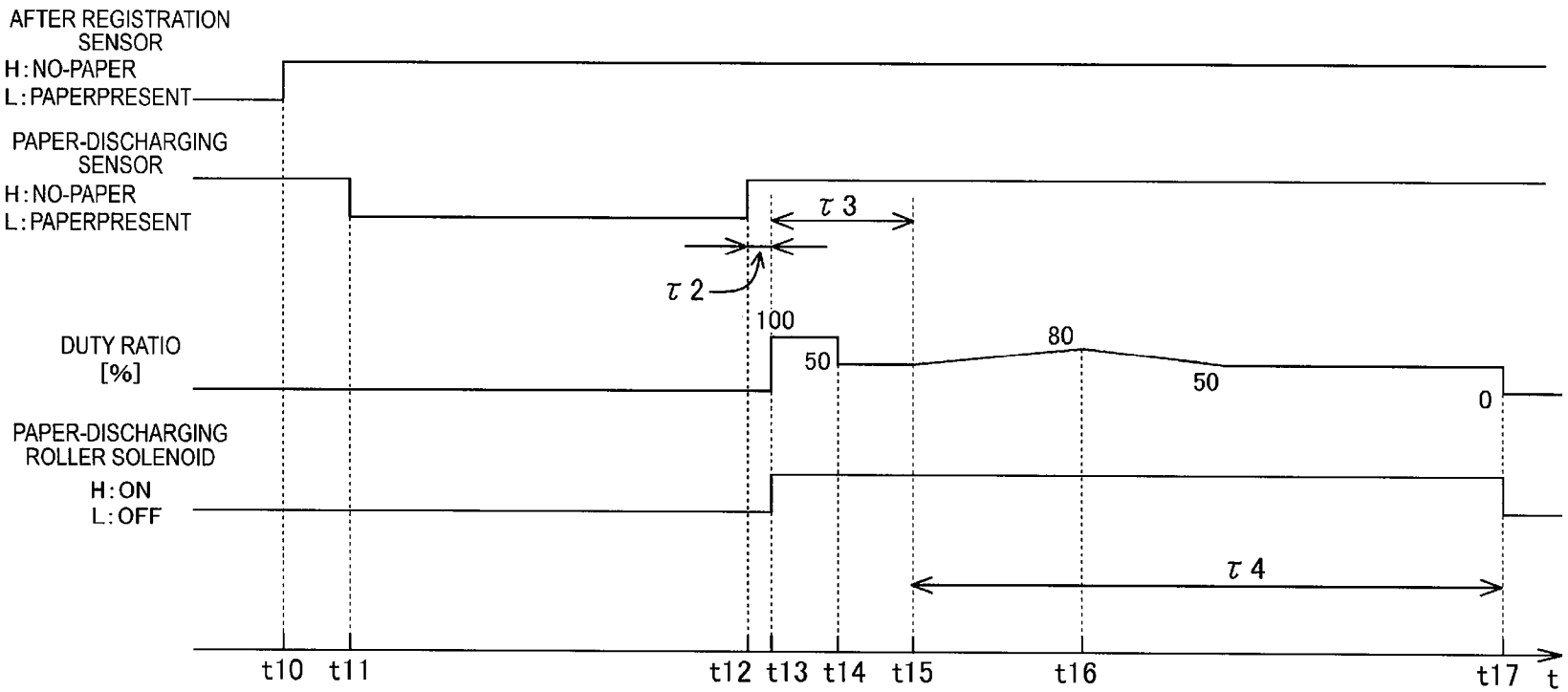
FIG. 8 is a time chart according to another example of a PWM control of a solenoid switch.

Next, in Aspect 4, one control example of the paper-discharging roller solenoid 63 is described as referring now to FIG. 8.

In order to perform printing processing of the color printer 1, it is assumed that the paper sheet 3 was carried to the downstream (in the carrying direction by) the registration roller 6, and here, at a time t10 in FIG. 8, the after-registration sensor S4 detected no-paper of the paper sheet 3. Next, at a time t11, it is assumed that a paper-discharging sensor S5 detected the paper sheet 3, and the paper sheet 3 was then carried to the discharging port 31 by the paper-discharging roller 30. At a time t12, it is also assumed that the paper-discharging sensor S5 detected no-paper of the paper sheet 3.

The CPU 120 then provides the PWM signal having 100% duty ratio to the paper-discharging roller solenoid 63 at a time t13 after a lapse of a predetermined period of time τ2 from the time t12, so as to turn on the paper-discharging roller solenoid 63. Then, the direction of the rotational power from the motor M to the paper-discharging roller 30 is reversed by the power transmitting mechanism (not shown), thereby inversely rotating the paper-discharging roller 30. The carrying direction of the paper sheet 3 is therefore reversed, from the discharging port 31 back to the side of the re-carrying path 51. Additionally, the paper-discharging sensor S5 is configured to detect no-paper of the paper sheet 3 even when the paper sheet 3 (with its carrying direction reversed) has passed.

Next, at a time t14 when a predetermined period of time has passed from the time 13, the CPU 120 reduces the duty ratio of the PWM signal from 100% to, for example, 50%. As mentioned, the reason for reducing the duty ratio of the PWM signal from 100% to 50% in a ON state of the paper-discharging roller solenoid 63 is because, similar to the registration solenoid 62, when starting the paper-discharging roller solenoid 63, an energy larger than the one after the start is required, however, after the start, the energy for holding the clutch of the paper-discharging roller solenoid 63 in a withdrawn state can be smaller than the one for withdrawing. Consequently, compared with a case where the duty ratio of the PWM signal is set constantly at 100% even after the start of the paper-discharging roller solenoid 63, the driving energy can be saved.

Then, after a predetermined period of time τ3 has passed from the time t13, and from a time t15 before the reversed paper sheet 3 entering into the re-carrying path 51 that joins with the carrying path 57, the CPU 120 gradually increases the duty ratio of the PWM signal from 50%. At that time, the duty ratio is preferably increased at every predetermined period of time by a prescribed value. Then, at a time t16 when the reversed paper sheet 3 enters into the re-carrying path 51 that joins with the carrying path 57, and if the duty ratio of the PWM signal reaches, for example, 80%, the CPU 120 gradually reduces the duty ratio of the PWM signal from 80% to, for example, 50%. At that time, the duty ratio is preferably reduced at every predetermined period of time by a prescribed value. The duty ratio of the PWM signal is then kept at 50%, and, at a time t17 when a predetermined period of time τ4 has passed from the time t15, the paper-discharging roller solenoid 63 is turned off. Here, the predetermined period of times τ2, τ3, and τ4 are respectively counted with, for example, a corresponding prescribed timer in the timer unit 123. In a period of time between the time t10 and the time t17, the motor M is driven.

As mentioned, the reason for increasing the duty ratio of the PWM signal from 50% to 80% in a ON state of the paper-discharging roller solenoid 63 is because, when the reversed paper sheet 3 enters into the re-carrying path 51 joining with the carrying path 57, the paper sheet 3 might contact a driving mechanism such as a carrying roller (not shown) provided in the re-carrying path 51, or enter into the section of a large curvature from the section of a small curvature within the re-carrying path 51. Here, when the vibration caused by the impact provided to the paper sheet 3 is transmitted to the paper-discharging roller 30 that is still holding the paper sheet 3, the vibration is then transmitted to the paper-discharging roller solenoid 63 since being positioned in the vicinity of the paper-discharging roller 30. This might cause the paper-discharging roller solenoid 63 to release its hold of the clutch. Releasing the clutch held by the paper-discharging roller solenoid 63 causes the paper-discharging roller 30 to positively rotate, thereby disturbing the printing processing.

In Aspect 4, the duty ratio of the PWM signal is therefore increased from 50% to 80%, so that the clutch is surely held by the paper-discharging roller solenoid 63 even with vibration caused by the impact on the paper sheet 3 at the time of entering into the re-carrying path 51 joining with the carrying path 57. This enables the clutch to be surely held by the paper-discharging roller solenoid 63 even with disturbances such as vibration caused by the impact on the paper sheet 3 at the time of entering into the re-carrying path 51 joining with the carrying path 57.

Other Aspects

The present invention is not limited to the aspects described in the above with reference to the accompanying figures, and, for example, the following can also be included in the technical scope of the present invention.

(1) In the above aspects, the CPU 120 may increase the duty ratio (the magnitude of driving signal) of the PWM signal of the solenoid switch at a high environmental temperature to be larger than that of the solenoid switch at a low environmental temperature. For example, the on-duty ratio is set at 90% when the environmental temperature is 10 degrees C., while being set at 100% when the environmental temperature is 30 degrees C.

This is because, in general, the resistance value of solenoid of a solenoid switch increases along with a rise of environmental temperature. And thus, the solenoid current relative to the same duty ratio decreases along with the suction force of the solenoid. The purpose is therefore to obtain a prescribed suction force of the solenoid without depending on the environmental temperature. In this case, even when the duty ratio is increased depending on a rise in the environmental temperature, the solenoid current does not increase, and thus, the solenoid can be controlled effectively according to the environmental temperature.

Additionally, in this case, the image forming apparatus is preferably provided with a temperature detecting member for detecting the environmental temperature to control the duty ratio of the PWM signal based on the detection result of the temperature detecting member. Alternatively, a solenoid current detecting member may be provided in order to control the duty ratio of the PWM signal based on a detection result thereof.

(2) In the above aspects, the example in which the CPU 120 turns on the registration solenoid 62 according to the detection of the paper sheet 3 by the manual insertion sensor S2 at the time t0 is shown, but is not limited to this. For example, the registration solenoid 62 may be turned on before the paper sheet 3 is detected by the manual insertion sensor S2. At that time, the CPU 120 preferably increases the duty ratio (the magnitude of driving signal) of the PWM signal at the time of detection of the paper sheet 3 by the manual insertion sensor (one example of a first detector) S2 to be greater than the duty ratio at the time of detection of the paper sheet 3 by the manual insertion sensor (one example of a second detector) S2. In this case, even when the paper sheet 3 is inserted from the paper feed opening 8 by an user, the electricity consumption can be controlled, while at the same time allowing control of the influence on motions of such as a registration solenoid arising out of disturbances such as vibration caused by the insertion of the paper sheet 3 into the paper feed opening 8.

(3) In the above aspects, examples are shown in which an image forming apparatus according to the present invention is applied to a color printer, however, an image forming apparatus according to the present invention can also be applied to a black-and-white printer. In such case, the duty ratio of the PWM signal of a registration solenoid (one example of a switch) is preferred to be greater than that for a color printer.

The reason for the above is, in a case of a black and white printer, an image forming unit for forming images on the paper sheet 3 (recording medium) is smaller compared with the one in a color printer, and thus, the registration solenoid for shifting its operation state easily gets high in temperature due to a shorter distance between a registration roller and a fixing unit compared with a color printer. Along the increasing temperature, the solenoid resistance increases easily.

(4) The configuration to gradually increase or decrease the duty ratio of the PWM signal is not limited to increasing or decreasing at every predetermined period of time by a prescribed value, in short, changing the duty ratio of the PWM signal in a constant gradient. A change gradient (changing amount) of the duty ratio of the PWM signal may be changed in accordance with time divisions.

(5) In the above aspects, the example in which the PWM signal is a driving signal of a solenoid switch (one example of a switch) while the magnitude of the driving signal is the duty ratio of the PWM signal is shown, but is not limited to this. For example, the driving signal may be a voltage signal of an alternating current, and the magnitude of the driving signal may be a voltage value thereof.

What is claimed is:

1. An image forming apparatus, comprising:

a carrier configured to carry a recording medium;

a power unit configured to provide drive power to the carrier;

a switch configured to switch an operation state of the carrier between an ON state and an OFF state of a transmission of the drive power from the power unit to the carrier;

a controller configured to provide a control power to control the switch such that the control power is reduced after switching from the OFF state to the ON state;

a first detector configured to detect the recording medium at a position before the carrier;

an insertion opening for inserting the recording medium; and a second detector configured to detect the recording medium being inserted into the insertion opening, wherein the controller increases the control power from a second control power to a first control power, the second control power being provided in response to the detection by the second detector, the first control power being provided in response to the detection by the first detector.

2. The image forming apparatus according to claim 1, wherein the carrier is a registration roller.

3. The image forming apparatus according to claim 2, wherein the controller increases the control power as the recording medium approaches the registration roller.

4. The image forming apparatus according to claim 1, wherein the controller gradually reduces the control power when the recording medium is held by the carrier at a time of warming up.

* * * * *